US005705997A

United States Patent [19]

Park

[11] Patent Number: 5,705,997

[45] Date of Patent: Jan. 6, 1998

[54] SELF ILLUMINATION CIRCUIT OF A HAND-HELD REMOTE CONTROL DEVICE AND SELF ILLUMINATION METHOD THEREOF

[75] Inventor: Chan Soo Park, Seoul, Rep. of Korea

[73] Assignee: Daewood Electronics Co., Ltd., Seoul, Rep. of Korea

[21] Appl. No.: 453,121

[22] Filed: May 30, 1995

[30] Foreign Application Priority Data

May 30, 1994 [KR] Rep. of Korea ..... 94-11857

[51] Int. Cl.[6] ..... H04Q 1/00

[52] U.S. Cl. ..... 340/825.49; 340/825.72; 341/176; 341/22; 362/109; 200/310

[58] Field of Search ..... 340/825.49, 825.55, 340/825.69, 825.72, 568, 571, 600; 341/176, 22; 345/169, 170; 359/142, 146, 48; 362/109; 200/310, 314, 315, 317; 455/352, 151.2; 348/734; 358/335; 315/159; 250/214 AL

[56] References Cited

U.S. PATENT DOCUMENTS

| | | | |
|---|---|---|---|
| 4,772,769 | 9/1988 | Shumate | 200/314 |
| 4,778,967 | 10/1988 | Deng | 200/315 |
| 5,132,681 | 7/1992 | Yabe et al. | 340/825.55 |
| 5,188,448 | 2/1993 | Siriani et al. | 362/109 |
| 5,204,586 | 4/1993 | Moore | 315/159 |
| 5,204,657 | 4/1993 | Prosser | 340/568 |
| 5,408,330 | 4/1995 | Squicciarini et al. | 358/335 |

FOREIGN PATENT DOCUMENTS

| | | | |
|---|---|---|---|
| 63-314991 | 12/1988 | Japan | 340/825.49 |

*Primary Examiner*—Edwin C. Holloway, III
*Attorney, Agent, or Firm*—Lowe, Price, LeBlanc & Becker

[57] ABSTRACT

A self illumination circuit of a hand-held remote control device and self illumination method make it easy to find and operate the remote control device when the remote control device is located in a dark environment. The circuit includes an illuminance sensing section, a contact sensing section, a key sensing section, a control section, a position indicating section, a key illuminating section, and a counter. If the illuminance sensing section senses illuminance of environment and transfers an illuminance sensing signal to the control section, the position indicating section indicates position of the remote control device according a position indicating signal from the control section. Upon receiving signals from the contact sensing section, the key sensing section, and the counter, the control section lights up, twinkles and puts out the key illuminating section.

10 Claims, 5 Drawing Sheets

SELF ILLUMINATION CIRCUIT OF A HAND-HELD REMOTE CONTROL DEVICE AND SELF ILLUMINATION METHOD THEREOF

BACKGROUND OF THE INVENTION

1. Field of the Invention

The present invention relates to a hand-held remote control device, more particularly, to a self illumination circuit of a hand-held remote control device and a self illumination method thereof by which the remote control device can be easily found and operated even in the dark.

2. Description of the Prior Art

Remote control devices are apparatuses for controlling various systems such as televisions, stereo systems, vehicles, cameras, industrial machines, and so forth, at a remote position from the systems. The remote control devices allow a user to control the operation of the systems at some distance from the system without direct contact between the user and operation panels of the systems.

The remote control devices control the systems by transmitting various control signals such as power ON/OFF, channel UP/DOWN, volume UP/DOWN, PLAY, MOVE, LIFT UP/DOWN and/or STOP signals to signal receiving sections on the operation panels of the systems.

Meanwhile, in using the above mentioned remote control devices, it is difficult for a user to distinguish function keys on the remote control devices when the remote control devices are in dark circumstances. Therefore, it is difficult for the user to control the system according to his intention in the dark.

U.S. Pat. No. 5,188,488 entitled "TV, VCR, Stereo, CD Night Light" granted to Siriani et al. on Feb. 23, 1993, discloses an illumination apparatus for a remote control device to solve the above problem.

As shown in FIG. 1, the apparatus has a housing 91 in which a remote control device 92 is inserted. Housing 91 has a lamp 93 for illuminating function keys of remote control device 92, and a switch 94 for switching the electric power supplied to lamp 93.

In the conventional apparatus, lamp 93 illuminates the function keys on remote control device 92 when a user closes switch 94 into housing 91, and then the user can distinguish function keys so as to easily control the system.

However, the apparatus requires a separate housing 91, and thereby the volume of the apparatus is large, so the production cost of the apparatus is high.

Moreover, a user can easily find the remote control device in bright circumstances, but not in dark environment. In addition, the user should grope for the switch on the housing and then close the switch in order to operate the remote control device even after he finds the remote control device in the dark, and the user must separate the remote control device from the housing when he wants to change a battery for supplying power to the lamp. Therefore, it is very inconvenient to operate and repair the conventional apparatus.

Futhermore, the lamp for illuminating the function keys can be destroyed by an unexpected collision with some materials because the lamp projects from the housing at the front of the remote control device.

SUMMARY OF THE INVENTION

The present invention is made to overcome the above described problems of the prior art, and therefore it is an object of the present invention to provide a self illumination circuit of a hand-held remote control device and a self illumination method of the remote control device by which the remote control device can be easily found and operated without any separate device even in dark environment.

To achieve the above object, the present invention provides a self illumination circuit of a hand-held remote control device comprising an illuminance sensing section for sensing illuminance of environment to generate an illuminance sensing signal; a contact sensing section for sensing contact of said remote control device to generate a contact sensing signal; a key sensing section having a plurality of function keys, and for generating a key sensing signal when any of said plurality of function keys is touched; a control section for receiving said illuminance sensing signal from said illuminance sensing section to generate a position indication signal, receiving said contact sensing signal from said contact sensing section to generate a key illumination signal and a time counting signal simultaneously while stopping the generation of said position indicating signal, and for receiving said key sensing signal from said key sensing section to generate a time counting stop signal; a position indicating section having a plurality of position indicating lamps for receiving said position indicating signal from said control section to turn on said plurality of position indicating lamps; a key illuminating section for receiving said key illuminating signal from said control section to illuminate said plurality of function keys; and a counter for receiving said time counting signal to count time, for receiving said time counting stop signal to stop said time counting and then to reset said counted time to an initial value, wherein said control section resets said counted time to said initial value when receiving said key sensing signal, determines whether any of said function keys is touched when said counted time is less than a first preset value, twinkles said plurality of function keys when said counted time is equal to or greater than a first preset value and stops said twinkling when any of said plurality of function keys is touched, stops said illuminating of said plurality of function keys when said counted time is equal to or greater than a second preset value, and after stopping said illuminating, said control section determines whether said contact sensing signal is received and then determines whether any of said plurality of function keys is touched when said contact sensing signal is received, illuminates said key illuminating section when any of said plurality of function keys is touched and then resets said counted time to determine whether any of said plurality of function keys is touched again.

The present invention also provides a self illumination method of a hand-held remote control device, said method comprising the steps of a) sensing an illuminance of environment; b) determining whether the environment is dark or light, executing again said step a) in the light environment and turning on a plurality of position indicating lamps of said remote control device in the dark environment; c) sensing whether said remote control device is touched or not, returning to said step a) if said remote control device is not touched, and turning off said plurality of position indicating lamps while lighting up a plurality of function keys if said remote control device is touched; d) resetting time to an initial value; e) sensing whether any of said plurality of function keys is touched or not, repeating said step d) after stopping twinkling said plurality of function keys when any of said plurality of function keys is touched, and counting time by adding a predetermined value to said initial value when any of said plurality of function keys is not touched, wherein said step e) is executed if said counted time is less than a first preset value, said step e) is executed after twinkling said plurality of function keys when said counted time is equal to or greater than said first preset value and less than a second preset value, and turning off said plurality of function keys when said counted time is equal to or greater than said second preset value;

f) sensing whether said remote control device is continuing in contact or not, executing said step a) when said remote control device is not continuing in contact; and g) sensing again whether any of said plurality of function keys is touched or not when said remote control device is continuing in contact in said step f), wherein said step f) is executed when any of said plurality of function keys is not touched and said step d) is executed after illuminating said plurality of function keys when any of said plurality of function keys is touched.

The self illumination circuit of a hand-held remote control device and self illumination method thereof according to the present invention as described above sense the illuminance of the environment and then indicate its position automatically and by itself, so that the remote control device can be easily found and operated even in the dark. Further, since the function keys are automatically lit on/off and flickered by a self illumination circuit and a self illumination method thereof, the remote control device has advantages such as convenience of use and reduction in power consumption.

BRIEF DESCRIPTION OF THE DRAWINGS

The above objects, and other features and advantages of the present invention will become apparent from the following description taken in conjunction with one embodiment thereof with reference to the accompanying drawings, in which.

DETAILED DESCRIPTION OF THE EMBODIMENT

Referring to the accompanying drawings, several embodiments of the present invention will be described in detail hereunder.

Figure 1:
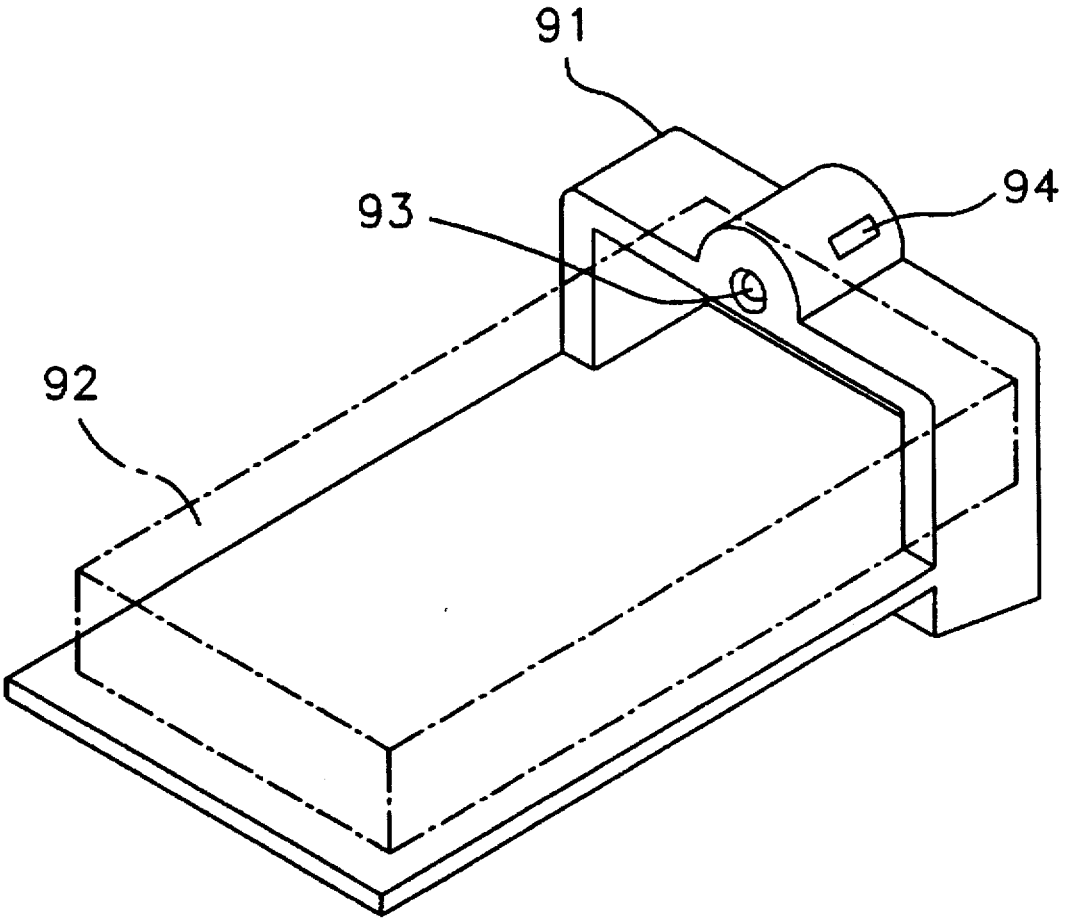
FIG. 1 PRIOR ART
FIG. 1 is a schematic perspective view of a conventional illumination apparatus for a remote control device.
Figure 2:
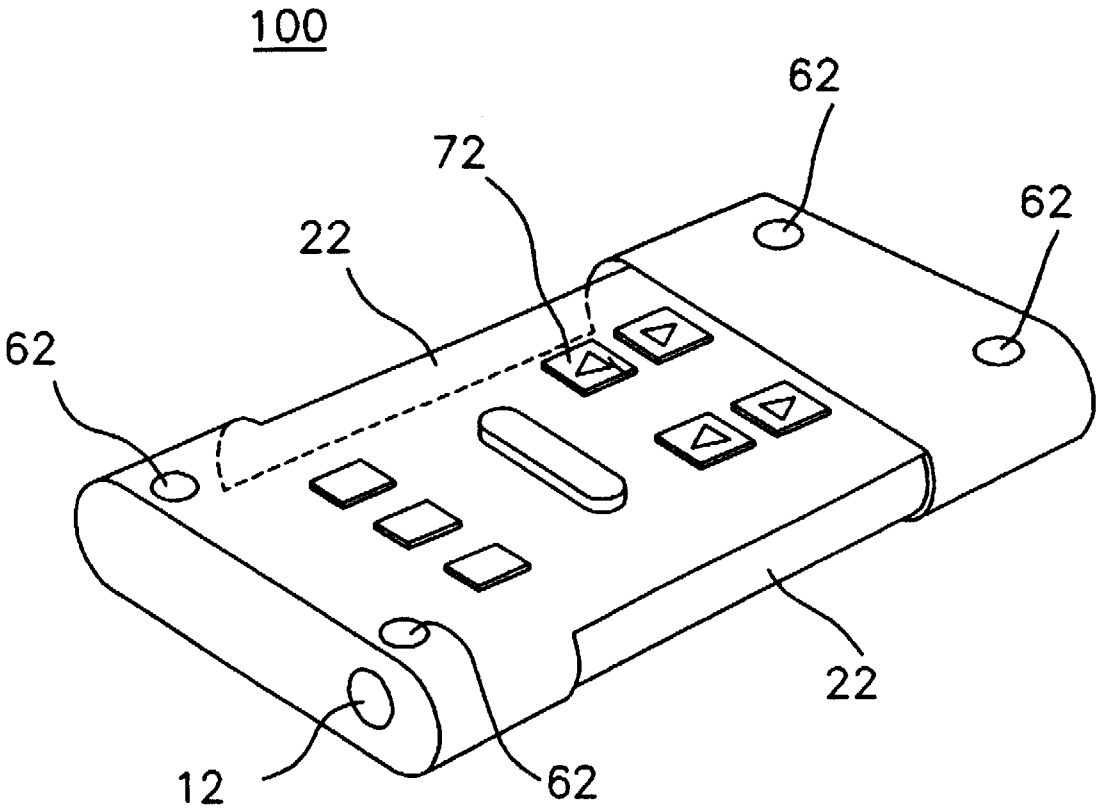
FIG. 2 is a perspective view of a hand-held remote control device according to a preferred embodiment of the present invention.

FIG. 2 is a perspective view of a hand-held remote control device 100 according to a preferred embodiment of the present invention. Remote control device 100 has a plurality of function keys 72 and a plurality of position indicating lamps 62, for example, four position indicating lamps 62, installed on the front surface of remote control device 100, an illuminance sensing member 12 disposed at a side of remote control device 100, and a plurality of contact switches 22 provided at opposite sides of remote control device 100, the opposite sides serving as grips of hand-held remote control device 100. In the present embodiment, two contact switches 22 are shown in FIG. 2 and a photoconductive element utilizing Cadmium Sulfide (CdS) whose electric resistance of which vaires with illuminance is utilized as illuminance sensing member 12.

Figure 3:
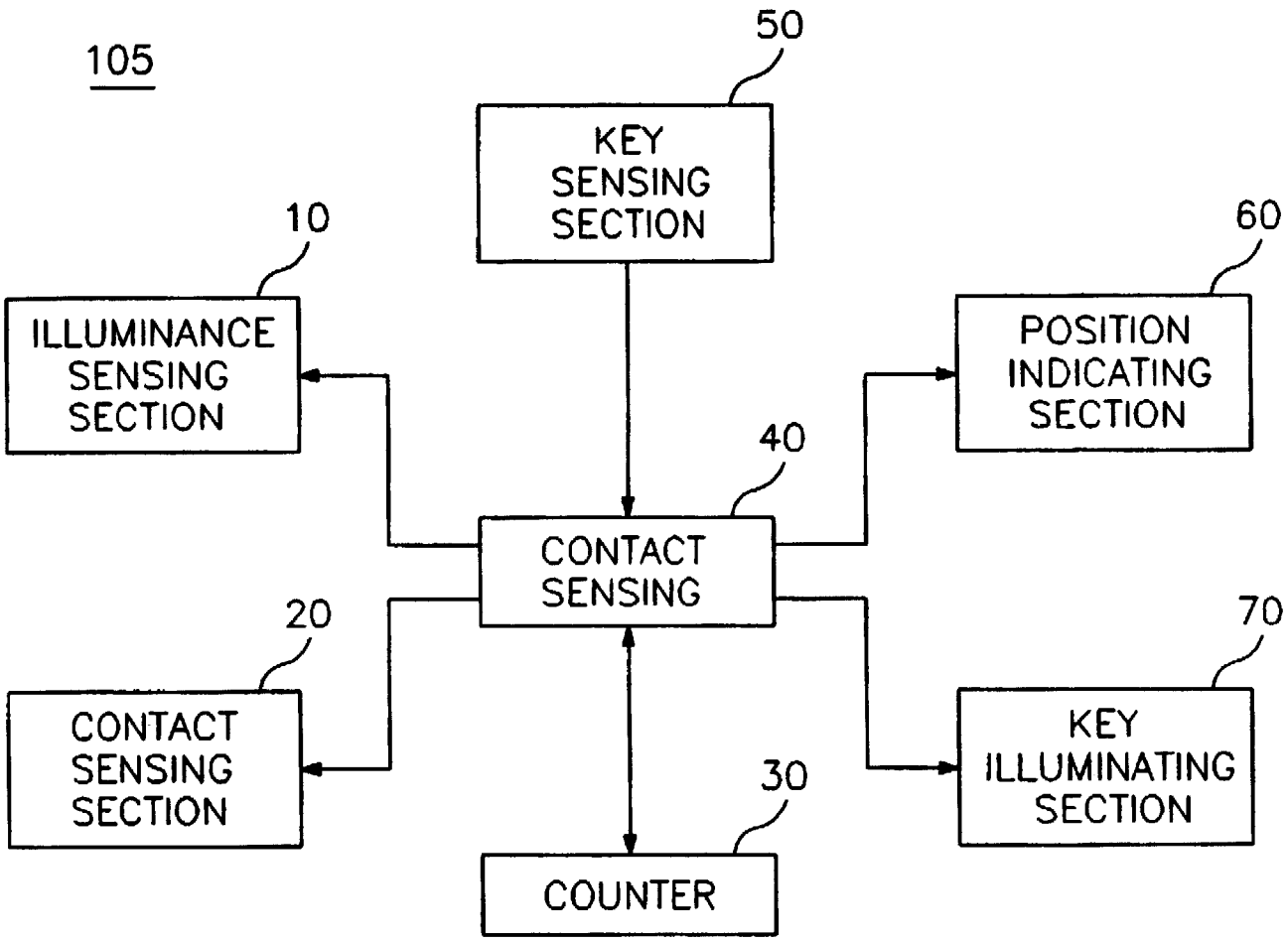
FIG. 3 is a block diagram of the self illumination circuit of the remote control device shown in FIG. 2.
Figure 4:
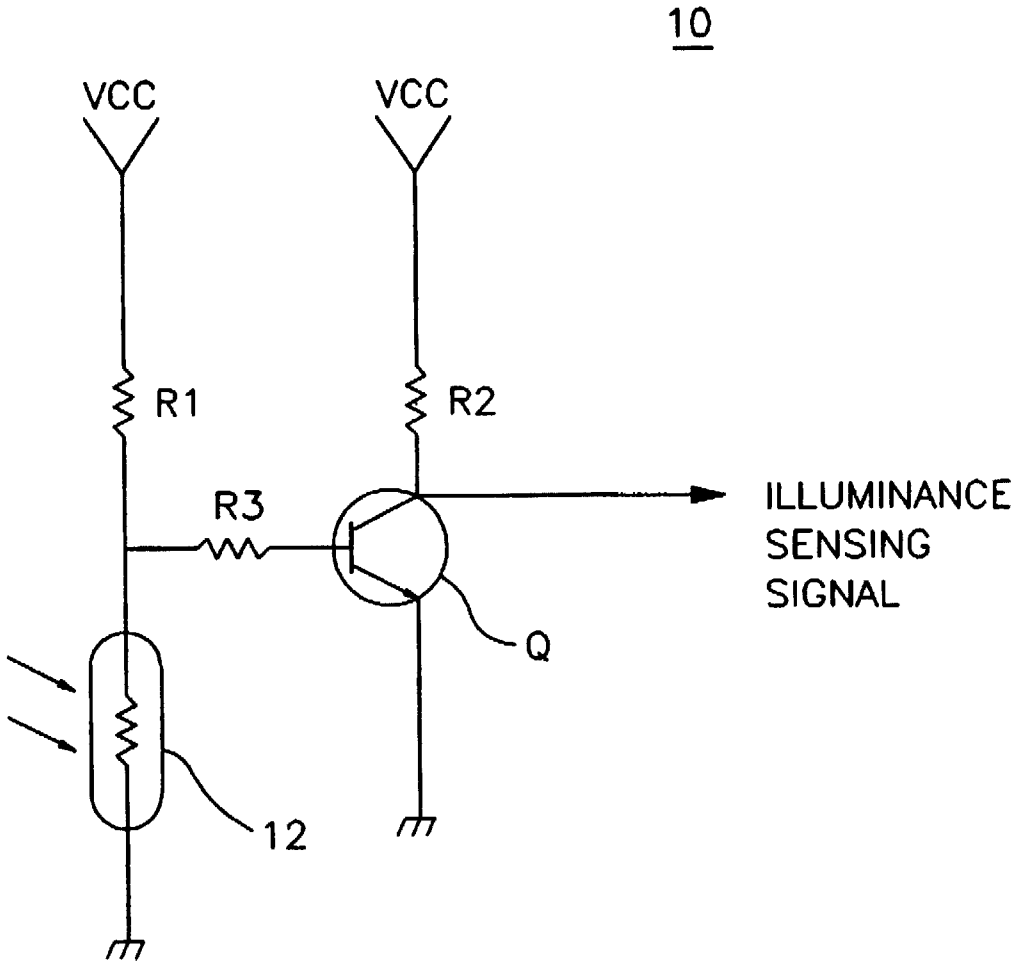
FIG. 4 is a circuit diagram of an illumination sensing section shown in FIG. 3.

FIG. 3 is a block diagram of the self illumination circuit 105 of remote control device 100 shown in FIG. 2, and FIG. 4 is a circuit diagram of an illuminance sensing section shown in FIG. 3. As shown in FIGS. 2, 3 and 4, the self illumination circuit 105 includes an illuminance sensing section 10, a contact sensing section 20, a counter 30, a control section 40, a key sensing section 50, a position indicating section 60, and a key illuminating section 70.

Key sensing section 50 includes a plurality of function keys 72 and a key matrix circuit(not shown) which is well known in the art. When any of function keys 72 is pressed, key sensing section 50 transfers a key sensing signal to control section 40.

Illuminance sensing section 10 senses the illuminance on around remote control device 100 and transfers an illuminance sensing signal to control section 40.

Illuminance sensing section 10 includes illuminance sensing member 12 made of CdS, a plurality of resistors R1, R2, and R3, and a transistor Q, as shown in FIG. 4. Illuminance sensing member 12 is electrically connected to operating power Vcc through resistor R1, a base node of transistor Q is electrically connected through resistor R3 to a node between resistor R1 and illuminance sensing member 12. A collector node of transistor Q is connected to operating power Vcc through resistor R2. An emitter node of transistor Q is grounded.

In illuminance sensing section 10 having the above mentioned structure, the resistance of illuminance sensing member 12 made of CdS varies with the intensity of light shed thereon, so that transistor Q is switched ON/OFF according to the variance of the resistance, and thereby an illuminance sensing signal is transferred to control section 40.

On the other hand, referring to FIG. 3 again, control section 40 transfers a position indicating signal to a position indicating section 60 after receiving illuminance sensing signal from illuminance sensing section 10.

Position indicating section 60 includes postion lamps 62. The position indicating signal from control section 40 lights up the plurality of position indicating lamps 62 for indicating the position of remote control device 100. Light-emitting diodes or small size lamps can be adopted as the plurality of position indicating lamps 62, between which light-emitting diodes are adopted in the present embodiment. Therefore, a user can easily discover remote control device 100 in dark environment.

Contact sensing section 20 may have a plurality of contact switches 22. Two contact switches 22 are shown in FIG. 2 for the preferred embodiment. As user finds remote control device 100 in which the plurality of position indicating lamps 62 have been lit up in dark environment and grips contact switches 22 of remote control device 100 so as to be switched ON, contact sensing section 20 transmits a contact sensing signal to control section 40. In general, open push button type switches or current sensing type switches can be used as contact switches 22. In this embodiment, the current sensing type switches are utilized in this embodiment.

When control section 40 receives the contact sensing signal from contact sensing section 20, control section 40 stops transferring the position indicating signal and transfers a key illuminating signal to key illuminating section 70. According to the stop of the transfer of the position indicating signal, the plurality of position indicating lamps 62 are put out. When control section 40 does not receive the contact sensing signal from contact sensing section 20, the self illumination circuit 105 restarts the initial state, that is, returns to the step of sensing illuminance.

Key illuminating section 70 has small lamps (not shown) installed under function keys 72 to be illuminated as can be seen in this art. The key illuminating signal from control section 40 lights up the plurality of function keys 72 by turning on the small lamps. The plurality of function keys 72 are made of transparent materials in order for light to pass therethrough, the user can distinguish and operate the plurality of function keys 72 in dark environment.

Control section 40 transfers a time counting signal to counter 30 simultaneously with transmitting the key illuminating signal to key illuminating section 70.

Counter 30 counts time according to the time counting signal and stops counting time according to a count stop signal, the signals coming respectively from control section 40 as usual.

On the other hand, key sensing section 50 transfers a key sensing signal to control section 40 when any of function keys 72 is pressed.

Control section 40 transfers the count stop signal to counter 30 when the key sensing signal is received from key sensing section 50 by control section 40. At this time, control section 40 stops transferring the time counting signal and resets a counted time value into an initial value.

If control section 40 has not received the key sensing signal until the counted time value T is equal to or greater than a first preset value T1 but less than a second preset value T2, control section 40 stops transferring the key illuminating signal and transfers a key twinkling signal to key illuminating section 70. The key twinkling signal actuates key illuminating section 70 to be twinkled. Control section 40 transfers the time counting signal to counter 30 to continue to count up the time value T.

If control section 40 has not received the key sensing signal until the counted time value T is equal to or greater than a second preset value T2, control section 40 stops transferring the key twinkling signal. As the transfer of the key twinkling signal from control section 40 is stopped, the illumination of the plurality of function keys 72 is stopped.

After the illumination of the plurality of function keys 72 is stopped, control section 40 determines whether the contact sensing signal is received from contact sensing section 20 or not.

In case the contact sensing signal from contact sensing section 20 is not received by control section 40, the self illumination circuit 105 restarts the initial state, that is, returns to the step of sensing illuminance.

In case the contact sensing signal is received by control section 40, control section 40 determines again whether the key sensing signal is received from key sensing section 50 or not.

In case the key sensing signal from key sensing section 50 is received by control section 40, control section 40 transfers the key illuminating signal to key illuminating section 70 and the time counting signal to counter 30 as mentioned above.

In case the key sensing signal from key sensing section 50 is not received by control section 40, control section 40 determines again whether the contact sensing signal is received from contact sensing section 20 or not as mentioned above after lighting up position indicating section 60.

Figure 5:
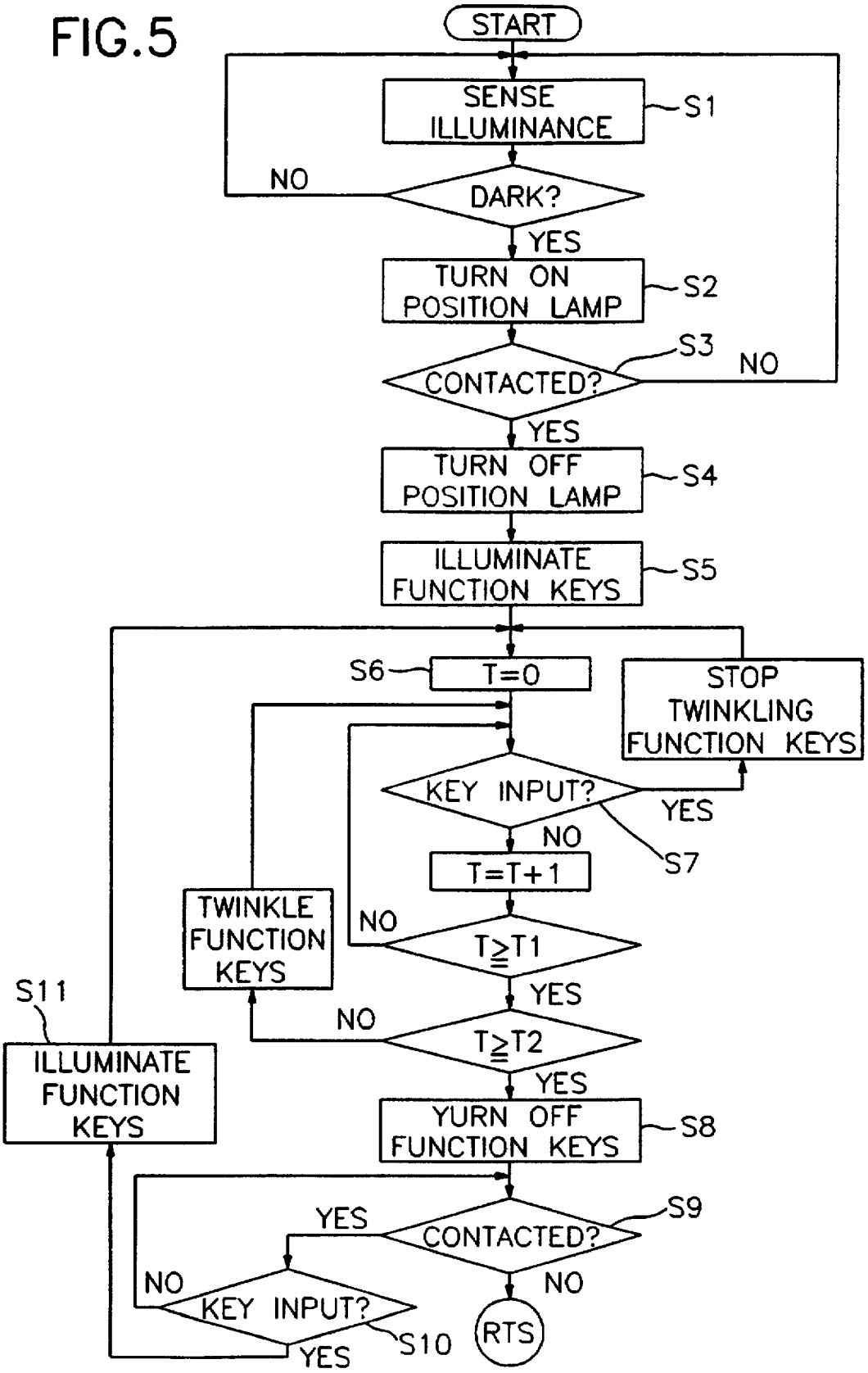
FIG. 5 is a flow chart for illustrating a self illumination method according to the self illumination circuit shown in FIG. 3.

Hereinafter, a self illuminating method of the self illumination circuit 105 having the above described construction according to the present embodiment will be described with reference to a flow chart shown in FIG. 5.

First, illuminance sensing section 10 senses illuminance and then determines whether the circumstance is dark or bright (step S1).

If bright, step S1 is executed again. However, if the circumstance is dark, control section 40 lights up the plurality of position indicating lamps 62 by means of transferring the position indicating signal to position indicating section 60 step S2).

At the state of lighting up the plurality of position indicating lamps 62, contact sensing section 20 determines whether contact switches 22 are touched or not (step S3).

If contact switches 22 are not touched, steps S1 and S2 are executed again. In the other case in which contact switches 22 are touched, control section 40 puts out the plurality of position indicating lamps 62 by means of halting the transfer of the position indicating signal (step S4) and lights up the plurality of function keys 72 by transferring the key illuminating signal to key illuminating section 70 (step S5).

Next, control section 40 sets counter 30 to the initial value of time T (T=0)(step S6), and then control section 40 senses whether the plurality of function keys 72 are touched or not (step S7).

If the plurality of function keys 72 are not touched, control section 40 controls counter 30 to add a predetermined value to the counted time T, for example to increase the counted time T by 1, and compares the counted time T with the first preset value T1.

When T is smaller than T1, control section 40 determines again whether the plurality of function keys 72 are touched or not, and control section 40 compares the counted time T with the first preset value T1 again. When T is equal to or greater than T1, control section 40 determines again whether the plurality of function keys 72 are touched or not, and control section 40 compares the counted time T with second preset value T2.

When T is equal to or greater than T1 and smaller than T2, control section 40 transfers the key twinkling signal to key illuminating section 70 so as to twinkle key illuminating section 70, and key sensing section 50 determines again whether the plurality of function keys 72 are touched or not.

If any one of the plurality of function keys 72 is touched, control section 40 resets the counted time T to the initial value, stops twinkling key illuminating section 70, and senses whether the plurality of function keys 72 are touched or not.

When the counted time T is equal to or greater than T2, control section 40 halts illumination or twinkling of the plurality of function keys 72, that is, turns off the plurality of function keys 72 (step S8).

At this state, contact sensing section 20 determines again whether touching of contact switches 22 is continuing or not (step S9).

When touching of contact switches 22 is not continuing, the procedures return to the initial state and repeat from step S1. When touching contact switches 22 is continuing, control section 40 determines whether any of the plurality of function keys 72 is touched or not (step S10).

When any of the plurality of function keys 72 is not touched, the procedures are returned to step S9.

When any of the plurality of function keys 72 is touched, control section 40 lights up the plurality of function keys 72 by transferring the key illuminating signal to key illuminating section 70 (step S11), and then the procedures are returned to step S6.

According to the present invention as described above, there is provided a remote control device which senses the illuminance of the environment and then indicates its position automatically and by itself, so that the remote control device can be easily found and operated even in the dark. Further, the plurality of function keys are automatically lit on/off and twinkled by a self illumination circuit and a self illuminating method thereof, so the remote control device has advantages such as convenience in using and reduction in power consumption.

Moreover, the remote control device of the present invention does not require any separate device for indicating its position and illuminating the the plurality of function keys, so that it can be minimized and compacted. Furthermore, the remote control device is easily operated and maintained, and can not be easily broken.

While the present invention has been particularly shown and described with reference to the preferred embodiments thereof, it will be understood by those skilled in the art that various changes in form and details may be effected therein without departing from the spirit and scope of the invention as defined by the appended claims.

What is claimed is:

1. A self illumination circuit of a hand-held remote control device, comprising:

an illuminance sensing section for sensing illuminance of environment to generate an illuminance sensing signal;

a contact sensing section for sensing contact of said remote control device to generate a contact sensing signal;

a key sensing section having a plurality of function keys, and for generating a key sensing signal;

a control section for receiving said illuminance sensing signal from said illuminance sensing section to generate a position indicating signal, receiving said contact sensing signal from said contact sensing section to generate a key illuminating signal and a time counting signal simultaneously while stopping the generation of said position indicating signal, and for receiving said key sensing signal from said key sensing section to generate a time counting stop signal;

a position indicating section having a plurality of position indicating lamps for receiving said position indicating signal from said control section to turning on said plurality of position indicating lamps;

a key illuminating section for receiving said key illuminating signal from said control section to illuminate said plurality of function keys; and a counter for receiving said time counting signal to count time, for receiving said time counting stop signal to stop said time counting and then to reset said counted time to an initial value, wherein said control section resets said counted time to said initial value when receiving said key sensing signal, determines whether any of said plurality of function keys is touched when said counted time is less than a first preset value, twinkles said plurality of function keys when said counted time is equal to or greater than a first preset value and stops said twinkling when any of said plurality of function keys is touched, stops said illuminating of said plurality of function keys when said counted time is equal to or greater than a second preset value, and after stopping said illuminating, said control section determines whether said contact sensing signal is received and then determines whether any of said plurality of function keys is touched when said contact sensing signal is received, illuminates said key illuminating section when any of said plurality of function keys is touched and then resets said counted time to determine whether any of said plurality of function keys is touched again.

2. A self illumination circuit of a hand-held remote control device as recited in claim 1, wherein said illuminance sensing section includes an illuminance sensing member, a first resistor, a second resistor, a third resistor, and a transistor, said illuminance sensing member being connected to an operating power source through said first resistor, a base of said transistor being connected between said first resistor and said illuminance sensing member, a collector of said transistor being connected to said operating power source through said second resistor, and an emitter of said transistor being grounded.

3. A self illumination circuit of a hand-held remote control device as recited in claim 2, wherein said illuminance sensing member is comprised of a cadmium sulfide (CdS) having a resistance which varies with an illuminance around said remote control device so as to turn on and off said transistor, so that said illuminance sensing signal is transferred to said control section.

4. A self illumination circuit of a hand-held remote control device as recited in claim 1, wherein said plurality of position indicating lamps are light-emitting diodes.

5. A self illumination circuit of a hand-held remote control device as recited in claim 1, wherein said plurality of function keys are made of a transparent material.

6. A remote control device as recited in claim 5, wherein said key illumination section includes small lamps installed under said plurality of function keys.

7. A self illumination circuit of a hand-held remote control device as recited in claim 5, wherein said contact sensing section includes contact switches.

8. A self illumination circuit of a hand-held remote control device as recited in claim 7, wherein said contact switches are current sensing switches.

9. A self illumination circuit of a hand-held remote control device, comprising:

an illuminance sensing section for sensing illuminance of environment to generate an illuminance sensing signal, said illuminance sensing section having an illuminance sensing member, a first resistor, a second resistor, a third resistor, and a transistor, wherein said illuminance sensing member is in series connected to operating power through said first resistor, a base of said transistor is connected between said first resistor and said illuminance sensing member, a collector of said transistor is in series connected to said operating power through said second resistor, an emitter of said transistor is grounded, said illuminance sensing member is comprised of a cadmium sulfide having a resistance which varies with illuminance around said remote control device so as to turn on and off said transistor, so that said illuminance sensing signal is transferred to said control section;

a contact sensing section for sensing contact of said remote control device to generate a contact sensing signal, said contact sensing section including contact switches;

a key sensing section having a plurality of function keys, and for sensing whether any of said plurality of function keys is operated or not to generate a key sensing signal;

a control section for receiving said illuminance sensing signal from said illuminance sensing section to generate a position indicating signal, receiving said contact sensing signal from said contact sensing section to generate a key illuminating signal and a time counting signal simultaneously while stopping the generation of said position indicating signal, and receiving said key sensing signal from said key sensing section to generate a time counting stop signal;

a position indicating section having a plurality of position indicating lamps for receiving said position indicating signal from said control section to turn on said plurality of position indicating lamps, said plurality of position indicating lamps being light-emitting diodes for lighting up said position indicating section according to said position indicating signal from said control section;

a key illuminating section for receiving said key illuminating signal from said control section to illuminate said plurality of function keys, said plurality of function keys being made of a transparent material; and a counter for receiving said time counting signal to count time, and for receiving said time counting stop signal to stop said time counting and then to reset a counted time into an initial value, wherein said control section resets the time to said initial value when receiving said key sensing signal, determines whether any of said function keys is touched when said counted time is less than a first preset value, twinkles said plurality of function keys when said counted time is equal to or greater than a first preset value and stops said twinkling when any of said plurality of function keys is touched, stops said illuminating of said plurality of function keys when said counted time is equal to or greater than a second preset value, and after stopping said illuminating, said control section determines whether said contact sensing signal is received and then determines whether any of said plurality of function keys is touched when said contact sensing signal is received, illuminates said key illuminating section when any of said plurality of function keys is touched and then resets the counted time to determine whether any of said plurality of function keys is touched again.

10. A self illumination method of a hand-held remote control device, said method comprising the steps of:

a) sensing an illuminance of environment;

b) determining whether the environment is dark or light, executing again said step a) in the light environment and turning on a plurality of position indicating lamps of said remote control device in the dark environment;

c) sensing whether said remote control device is touched or not, returning to said step a) if said remote control device is not touched, and turning off said plurality of position indicating lamps while lighting up a plurality of function keys if said remote control device is touched;

d) resetting a counted time to an initial value;

e) sensing whether any of said plurality of function keys is touched or not, repeating said step d) after stopping twinkling said plurality of function keys when any of said plurality of function keys is touched, and counting time by adding a predetermined value to said initial value when any of said plurality of function keys is not touched, wherein said step e) is executed if said counted time is less than a first preset value, said step e) is executed again after twinkling said plurality of function keys when said counted time is equal to or greater than said first preset value and less than a second preset value, and turning off said plurality of function keys when said counted time is equal to or greater than said second preset value;

f) sensing whether said remote control device is continuing in contact or not continuing in contact again, executing said step a) when said remote control device is not continuing in contact; and g) sensing again whether any of said plurality of function keys is touched or not when said remote control device is continuing in contact in said step f), wherein said step f) is executed when any of said plurality of function keys is not touched and said step d) is executed after illuminating said plurality of function keys when any of said plurality of function keys is touched.

* * * * *